US006422198B1

(12) United States Patent
VanBrocklin et al.

(10) Patent No.: US 6,422,198 B1
(45) Date of Patent: Jul. 23, 2002

(54) PRESSURE ATOMIZER HAVING MULTIPLE ORIFICES AND TURBULENT GENERATION FEATURE

(75) Inventors: Paul G. VanBrocklin, Pittsford; Gail E. Geiger, Caledonia; Donald James Moran; Stephane Fournier, both of Rochester, all of NY (US)

(73) Assignee: Delphi Technologies, Inc., Troy, MI (US)

( * ) Notice: Subject to any disclaimer, the term of this patent is extended or adjusted under 35 U.S.C. 154(b) by 84 days.

(21) Appl. No.: 09/664,669

(22) Filed: Sep. 19, 2000

(51) Int. Cl.[7] ..... F02B 3/00; B05B 1/34

(52) U.S. Cl. ..... 123/294; 123/298; 239/468; 239/518; 239/520

(58) Field of Search ..... 123/294, 280, 123/298; 239/125, 126, 468, 467, 498, 518, 520

(56) References Cited

U.S. PATENT DOCUMENTS 3,680,793 A * 8/1972 Tate et al. ..... 239/468
3,746,257 A * 7/1973 Broad et al. ..... 239/102.2
4,109,870 A * 8/1978 Wolber ..... 239/558
4,790,480 A * 12/1988 Rennie ..... 239/125
5,044,562 A * 9/1991 Rogers et al. ..... 239/543
5,143,297 A * 9/1992 De Michele et al. ..... 239/427

FOREIGN PATENT DOCUMENTS

DE 30 17 050 A1 * 11/1981 ..... F23M/9/06

* cited by examiner

*Primary Examiner*—William C. Doerrler
*Assistant Examiner*—Hieu T. Vo
(74) *Attorney, Agent, or Firm*—John VanOphem

(57) ABSTRACT

A pressure atomizer includes a silicon plate having a top surface and a bottom surface. A portion of the top surface defines a turbulent chamber. The turbulent chamber is peripherally bounded by the top surface of the plate. The turbulent chamber is recessed a predetermined depth relative to the top surface. The silicon plate further defines at least one flow orifice. Each flow orifice extends from the bottom surface of the silicon plate to intersect with and open into the turbulent chamber. Each flow orifice is in fluid communication with the turbulent chamber.

32 Claims, 4 Drawing Sheets

PRESSURE ATOMIZER HAVING MULTIPLE ORIFICES AND TURBULENT GENERATION FEATURE

This invention was made with United States Government support under Cooperative Agreement No. DE-FC02-99EE50573 awarded by DOE. The Govemment has certain rights in invention.

TECHNICAL FIELD

The present invention relates generally to nozzles for the atomization of fluids and, more particularly, to pressure atomizer nozzles used for atomizing fuel before injection into an internal combustion engine.

BACKGROUND OF THE INVENTION

Automobile emissions are said to be the single greatest source of pollution in several cities across the country. Automobiles emit hydrocarbons, nitrogen oxides, carbon monoxide and carbon dioxide as a result of the combustion process. The Clean Air Act of 1970 and the 1990 Clean Air Act set national goals of clean and healthy air for all and established responsibilities for industry to reduce emissions from vehicles and other pollution sources. Standards set by the 1990 law limit automobile emissions to 0.25 grams per mile (gpm) non-methane hydrocarbons and 0.4 gpm nitrogen oxides. The standards are predicted to be further reduced by half in the year 2004.

It is expected that automobiles will continue to be powered by internal combustion engines for decades to come. As the world population continues to grow, and standards of living continue to rise, there will be an even greater demand for automobiles. The major challenge facing automobile manufacturers is to reduce undesirable emissions and improve fuel economy, thereby assuring the increased number of automobiles has a minimal impact on the environment. One method by which automobile manufacturers have attempted to improve fuel economy and reduce undesirable emissions is through direct fuel injection.

Generally, direct injection (DI) is the spraying of fuel under pressure through the nozzle of a fuel injector and into the combustion chamber of an internal combustion engine. By spraying a very precise amount of fuel in the form of atomized fuel particles into the combustion chamber, DI realizes a substantial reduction in undesirable emissions and an increase in fuel economy. Generally, the requirements for an efficient DI system are small fuel particle size, control of spray penetration, and control of the dispersion of the fuel particles within the combustion chamber.

The extent to which the injected fuel is atomized, as measured by the fuel particle size, is a critical factor in the efficiency of DI systems. Incompletely atomized fuel has large particle size whereas fuel that is substantially completely atomized has small particle size. Large fuel particles in DI systems create uncontrolled localized high concentrations of fuel within the combustion chamber. The large fuel particles evaporate into the combustion charge relatively slowly. Thus, an incomplete combustion process may result. In contrast, smaller fuel particles evaporate into the combustion charge relatively quickly, thereby promoting a homogenous mixture of fuel and air within the combustion chamber and a more complete combustion process. The more complete combustion process, in turn, reduces the level of undesirable emissions.

Spray penetration and dispersion are also critical factors which must be controlled in order to ensure an efficient DI system. Spray penetration is controlled to prevent undesirable wetting of the combustion chamber wall with fuel. Any fuel that wets the combustion chamber wall is not likely to evaporate into suspension with the combustion charge. Thus, the combustion process is likely to be incomplete and to result in increased levels of undesirable emissions. Spray dispersion determines levels at which fuel is concentrated within various parts of the combustion chamber. As stated above, uncontrolled localized high concentrations of fuel within the combustion chamber are undesirable as they may result in an incomplete combustion process and higher levels of undesirable emissions. However, under certain operating conditions, controlled and targeted localized high concentrations of fuel within the combustion chamber, such as, for example, proximate the spark plug, are desirable. The purposeful creation of targeted localized high concentrations of fuel is known as stratification of the combustion charge, and is central to realizing the benefits of increased fuel economy and reduced emissions in a DI system. Stratification of the combustion charge enables an engine to operate with a very lean overall combustion charge, even under partial load conditions.

Conventional DI systems atomize fuel by flowing the fuel under pressure through the nozzle of a fuel injector and into the combustion chamber. As the pressure is increased, the atomization of the fuel increases and particle size is reduced. In order to achieve sufficiently small fuel particle size, conventional DI systems require the fuel to flow through the nozzle under relatively high pressure, such as, for example, from 5 to 12 MPa. Although these high pressures may achieve adequate fuel atomization, the injected fuel has a correspondingly high spray front velocity, such as, for example, above forty meters per second. With such high spray front velocities, it is difficult to achieve desirable levels of spray penetration and spray dispersion. Thus, fuel is likely to be impinged upon the combustion chamber wall and/or highly and uncontrollably dispersed within the combustion chamber. In fact, due to the high operating pressures required to adequately atomize fuel and the resulting high spray front velocities, many conventional DI systems must impinge fuel off the combustion chamber wall and/or the piston to create a stratified combustion charge. Furthermore, conventional DI systems require a high-pressure fuel pump and high-pressure fuel rails thereby adding complexity, weight, and cost to the DI system. Moreover, the nozzle of the fuel injector must be machined to exacting tolerances, making the nozzle difficult to manufacture, sensitive to manufacturing variations, and costly to procure.

Advanced DI systems may include nozzles constructed with synthetic materials and/or advanced machining processes. For example, advanced nozzles may be compound structures including two or more elements which are bound together. Such advanced nozzles may further include several inlet orifices and a single outlet orifice. However, such compound nozzles require multiple machining operations upon each element. Further, the elements must then be precisely aligned and bonded together. Thus, such advanced nozzles require relatively large amounts of materials and multiple processing. Moreover, such nozzles typically include relatively high, and thus undesirable, sac volume. Sac volume is the volume of fluid that, due to surface tension, clings to an outlet orifice of a nozzle after flow is ceased. In the context of DI systems, the sac volume is a volume of non-atomized fuel which, upon the next injection event, is injected into the combustion chamber. This non-atomized volume of fuel is not metered or controlled, nor does it disperse well or evaporate quickly within the combustion chamber. As a result of a relatively high sac volume, the level of undesirable emissions are increased and fuel economy is decreased. Compound nozzles have a relatively high sac volume since the non-atomized fuel will cling to the walls of the multiple orifices formed in each element.

Therefore, what is needed in the art is a pressure atomizer which efficiently atomizes fuel under substantially lower pressure than conventional fuel atomizer nozzles to thereby eliminate the need for high-pressure components, such as, for example, a high-pressure fuel pump.

Furthermore, what is needed in the art is a pressure atomizer that enables stratification of the combustion charge, control of spray dispersion and spray penetration.

Still further, what is needed in the art is a pressure atomizer that substantially reduces spray velocities to thereby improve control of spray dispersion, spray penetration, and stratification of the combustion charge.

Even further, what is needed in the art is a pressure atomizer that achieves small fuel droplet size and low spray penetration to thereby increase fuel economy and decrease undesirable emissions.

Yet further, what is needed in the art is a pressure atomizer that minimizes sac volume.

Moreover, what is needed in the art is a single element, or non-compound, pressure atomizer that eliminates machining multiple elements and the process of bonding the elements together.

SUMMARY OF THE INVENTION

The present invention provides a pressure atomizer for use in fuel injection systems.

The invention comprises, in one form thereof, a silicon plate having a top surface and a bottom surface. A portion of the top surface defines a turbulent chamber. The turbulent chamber is peripherally bounded by the top surface of the plate. The turbulent chamber is recessed a predetermined distance relative to the top surface. The silicon plate further defines at least one flow orifice. Each flow orifice extends from the bottom surface of the silicon plate to intersect with and open into the turbulent chamber. Each flow orifice is in fluid communication with the turbulent chamber.

An advantage of the present invention is that fuel is substantially completely atomized in an efficient manner and at substantially lower pressure than in conventional pressure atomizer nozzles.

Another advantage of the present invention is that the need for high-pressure components, such as, for example, a high-pressure fuel pump, are eliminated.

A still further advantage of the present invention is that the sac volume of fuel is substantially reduced over conventional compound pressure atomizer nozzles.

An even further advantage of the present invention is that spray front velocities are substantially reduced to thereby improve spray dispersion, spray penetration, and stratification of the combustion charge.

Lastly, an advantage of the present invention is that a single silicon plate is used, thereby eliminating the need to machine multiple nozzle elements and to bond the elements together.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DESCRIPTION OF THE PREFERRED EMBODIMENTS

Figure 1:
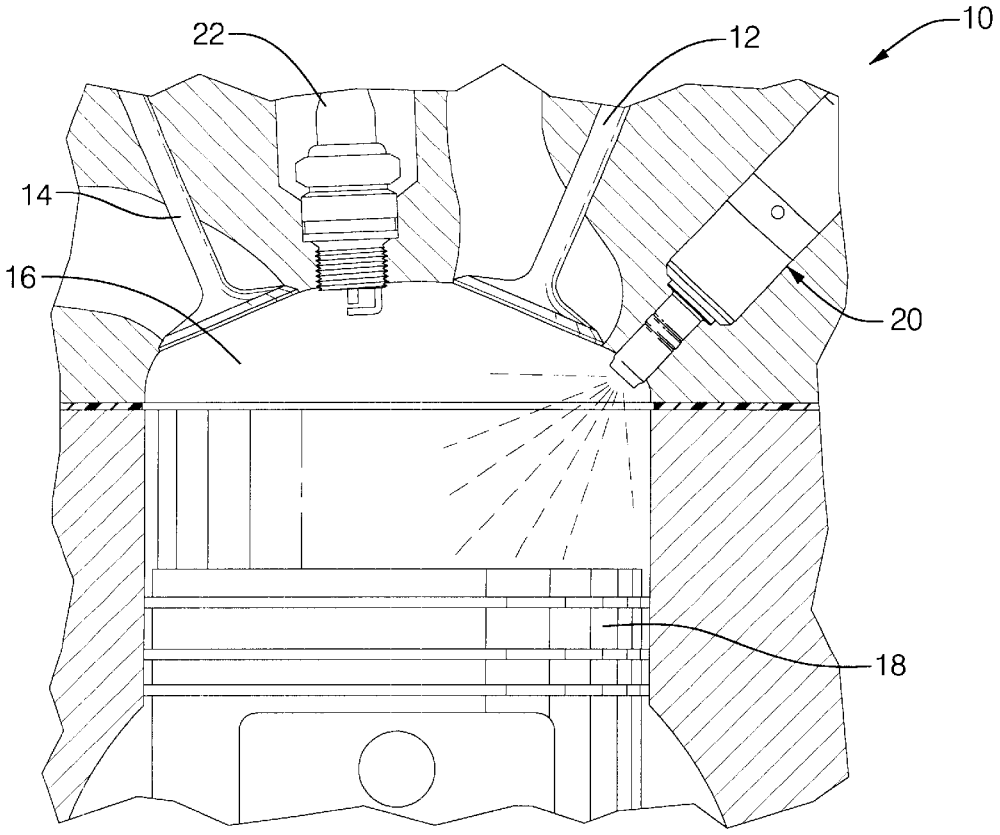
FIG. 1 is a partially-sectioned view of an internal combustion engine having a direct fuel injection system including a fuel injector incorporating one embodiment of a pressure atomizer of the present invention.
Figure 3:
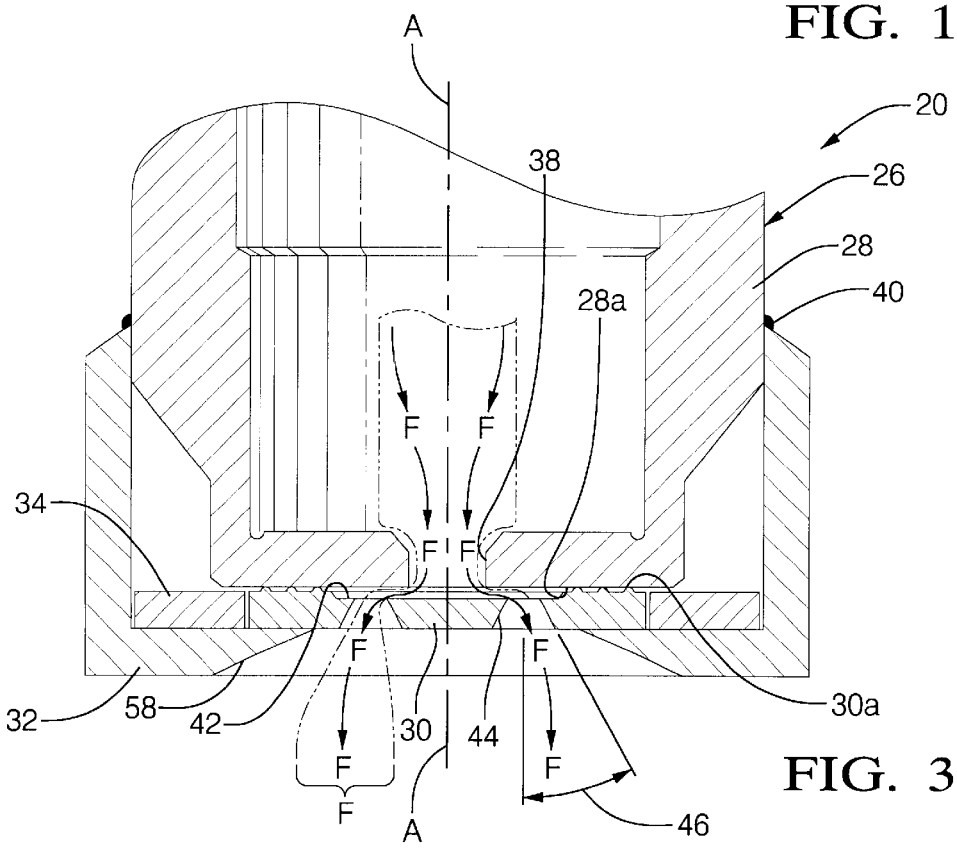
FIG. 3 is detail, sectional view of the fuel injector and pressure atomizer of FIG. 2.
Figure 2:
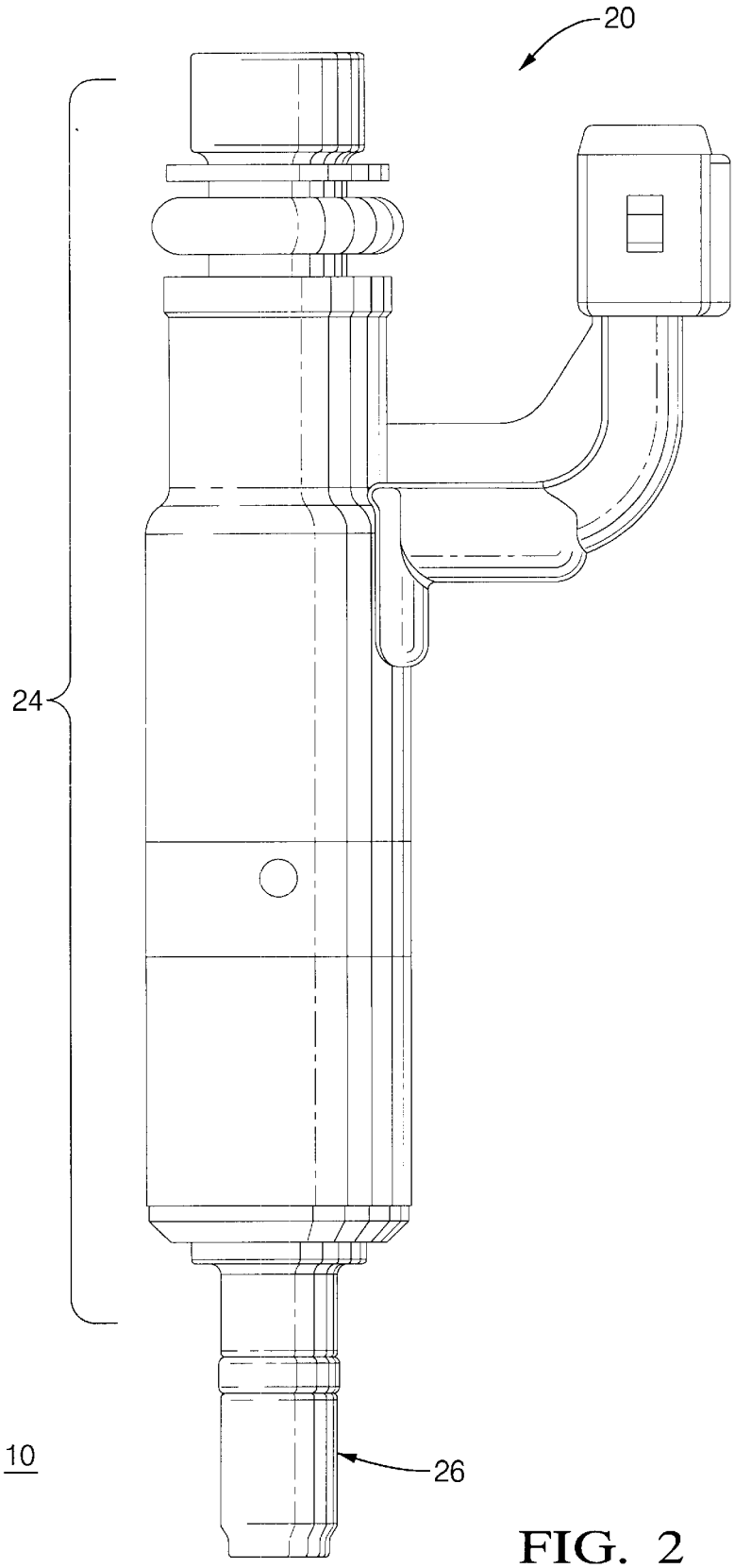
FIG. 2 is a sectional view of a fuel injector incorporating the pressure atomizer of FIG. 1.

Referring now to the drawings and particularly to FIG. 1, there is shown an internal combustion engine having a fuel injector incorporating one embodiment of a pressure atomizer of the present invention. Internal combustion engine 10 includes intake valve 12 and exhaust valve 14, combustion chamber 16, piston 18 and fuel injector 20. Fuel injector 20 injects fuel directly into combustion chamber 16, where it is mixed with air and then ignited by spark plug 22. Referring now to FIG. 2, fuel injector 20 includes body portion 24 and lower housing and tip assembly 26. As best shown in FIG. 3, lower housing and tip assembly 26 of fuel injector 20 includes injector seat 28, pressure atomizer 30, cap 32, and washer 34. Lower housing and tip assembly 26 has central axis A. Generally, and as will be described more particularly hereinafter, pressure atomizer 30 is disposed between retainer cap 32 and injector seat 28. Fuel exits injector seat 28, as controlled by an associated valve (not shown), and is atomized as it flows in direction F through the hereinafter described structural features of atomizer 30.

Injector seat 28 is a substantially cylindrical member having seat bottom 28*a*. Seat bottom 28*a* defines injector seat exit orifice 38 therethrough. Injector seat exit orifice 38 is substantially cylindrical and is substantially concentric about central axis A and with injector seat 28. Injector seat exit orifice 38 is of a predetermined diameter.

Figure 4:
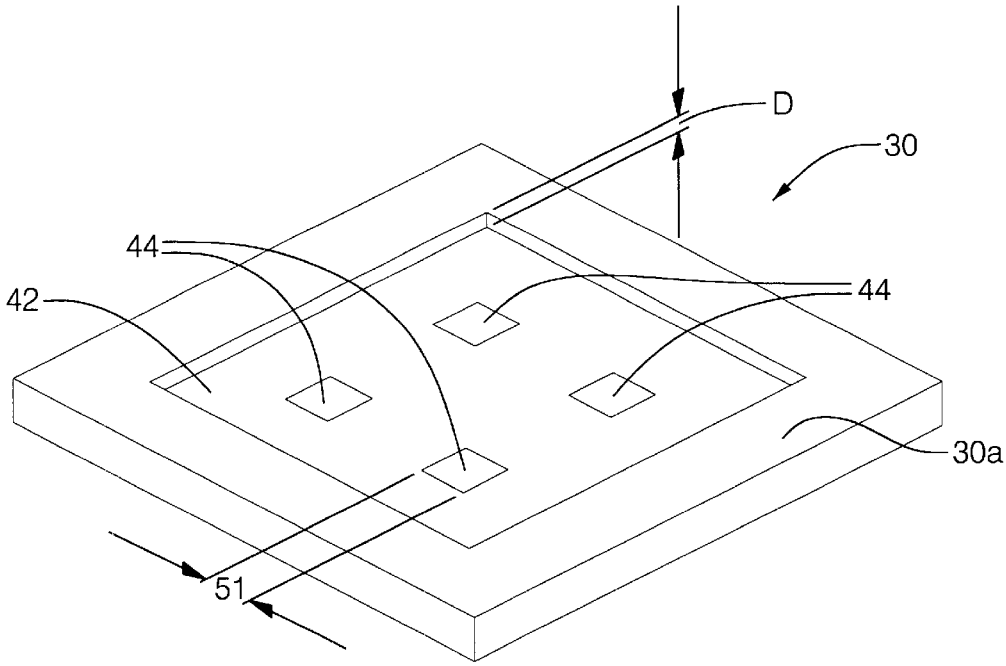
FIG. 4 is top view of the pressure atomizer of FIG. 2.
Figure 5:
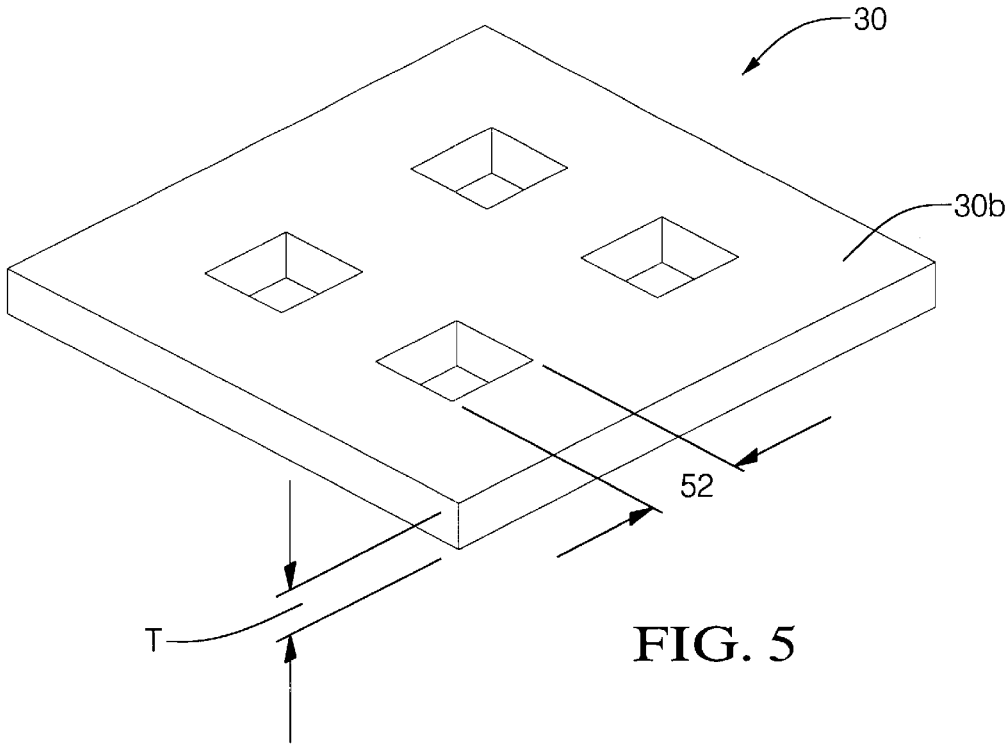
FIG. 5 is a bottom view of the pressure atomizer of FIG. 2.

Pressure atomizer 30 is a substantially square silicon plate member. As best shown in FIGS. 4 and 5, pressure atomizer 30 further includes top surface 30*a*, bottom surface 30*b*, turbulent chamber 42 and flow orifices 44. Top surface 30*a* of pressure atomizer 30 is disposed in abutting engagement with seat bottom 28*a* of injector seat 28, such that at least a portion of turbulent chamber 42 is in axial alignment with injector seat exit orifice 38. Turbulent chamber 42 is substantially square, and is recessed from top surface 30*a* by a predetermined distance or depth D. Depth D is, for example, from approximately 75 $\mu$m to approximately 150 $\mu$m.

Flow orifices 44 are defined by pressure atomizer 30. Each flow orifice 44 intersects with and opens into turbulent chamber 42 at one end, and opens into and intersects with bottom surface 30*b* of pressure atomizer 30 at an opposite end. Each flow orifice 44 is substantially square at its interface with turbulent chamber 42 and at its interface with bottom surface 30*b*. Each flow orifice 44 tapers from having a predetermined cross-sectional area proximate turbulent chamber 42 to a predetermined cross-sectional area proximate bottom surface 30*b* of pressure atomizer 30. The cross-sectional area of each flow orifice 44 proximate turbulent chamber 42 is less than the cross-sectional area of each flow orifice 44 proximate bottom surface 30*b*. Thus, flow orifice angle 46 is formed (FIG. 3). Each of flow orifices 44 have side dimension S1 (FIG. 4) at turbulent chamber 42, and side dimension S2 at bottom surface 30*b* (FIG. 5), and each flow orifice 44 has a depth equal to the thickness T (FIG. 5) of pressure atomizer 30 minus depth D of turbulent chamber 42. Flow orifices 44 are spaced substantially equidistant from and about central axis A and, thus, equidistant from and about injector seat exit orifice 38. No portion of the interface of any of flow orifices 44 with turbulent chamber 42 (i.e., no portion of the openings of flow orifices 44 in turbulent chamber 42) lie directly below, or directly downstream from, injector seat exit orifice 38.

Each of turbulent chamber 42 and flow orifices 44 are formed by micromachining, such as, for example, known masking and double-sided anisotropic etching processes. Etching creates molecularly sharp corners and internal surfaces within turbulent chamber 42 and flow orifices 44, upon which fuel will impact as it flows therethrough, thereby increasing the atomization efficiency of pressure atomizer 30. Flow orifice angle 46 is determined in part by the direction in which etching occurs.

Retainer cap 32 is a substantially cylindrical member that is attached in a fluid and air tight manner, such as, for example, by a 360° (three-hundred and sixty degree) laser weld 40 to injector seat 28. Retainer cap 32 defines fuel nozzle 58, which is concentric about central axis A. Fuel nozzle 58 is substantially concentric with central axis A of fuel injector 20. Fuel nozzle 58 increases in diameter in a direction away from pressure atomizer 30. Thus, fuel nozzle 58 increases in diameter from a predetermined smaller diameter at the inside surface thereof (i.e. the surface of fuel nozzle 58 that is adjacent pressure atomizer 30) to a predetermined larger diameter at its outside surface. The increasing diameter of fuel nozzle 58, as described above, prevents drip formation upon fuel nozzle 58. Thus, fuel spray exiting nozzle 58 is not hindered by drips formed upon fuel nozzle 58.

Figure 6:
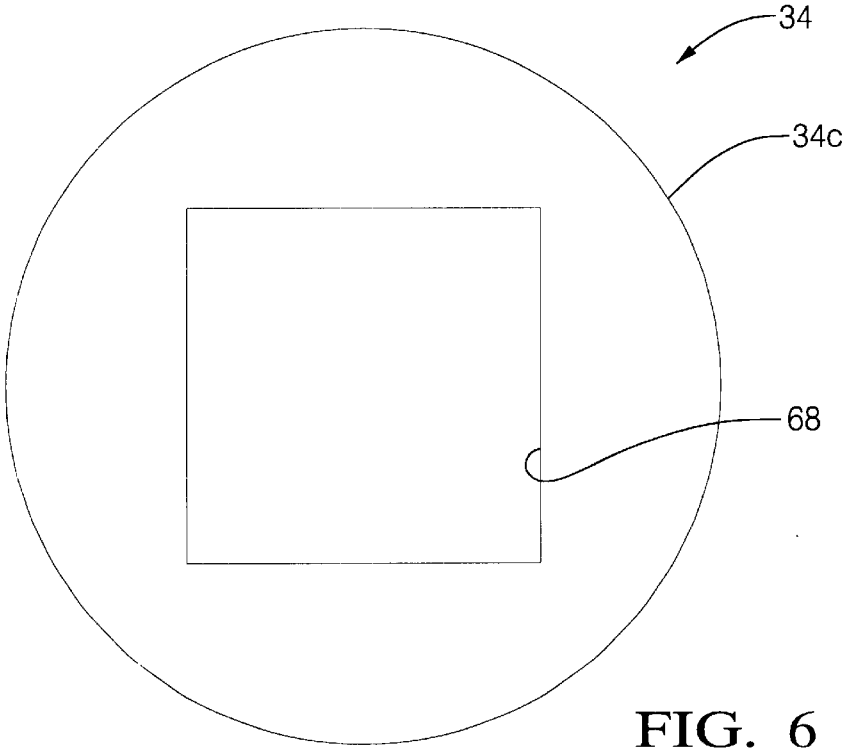
FIG. 6 is a top view of a washer used in the fuel injector having the pressure atomizer of FIG. 2.

Washer 34, as best shown in FIG. 6, is a substantially cylindrical washer member defining a square aperture 68 therein. Pressure atomizer 30 is received within square aperture 68 such that pressure atomizer 30 is radially surrounded by washer 34. The outside surface 34*a* of washer 34 abuttingly engages the inside surface (not referenced) of retainer cap 32. Thus, washer 34 establishes and maintains the radial position of pressure atomizer 30 relative to injector seat exit orifice 38.

In use, pressurized fluid, such as, for example, fuel is atomized as it is flows in direction F through injector seat exit orifice 38 and pressure atomizer 30. The fuel flows under a pressure, such as, for example, from about 1.5 MPa to less than about 5 MPa. Thus, atomization pressure is substantially reduced from the pressure of, for example, 5–12 MPa as used in conventional DI systems/atomizers and the need for a high-pressure fuel rail and a high-pressure fuel pump is eliminated. The fuel flows axially through injector seat exit orifice 38 and into turbulent chamber 42. Fuel is first sheared at the edge or rim of injector seat exit orifice 38 that is proximate turbulent chamber 42, where the fuel is forced to turn from an axially-directed flow to a radially-directed flow (i.e., a ninety-degree turn). The shearing of fuel at the edge of injector seat exit orifice 38 proximate to turbulent chamber 42 creates turbulent eddies in the fuel, which increase the degree of atomization of the fuel and thus the efficiency with which fuel atomizer 30 atomizes fuel. Further, swirling of the fuel is created by the positioning of flow orifices 44 a predetermined radial distance from central axis A such that flow orifices 44 lie outside the flow of fuel exiting injector seat exit orifice 38. The swirling thus created increases atomization efficiency. Fuel continues to flow in the radial direction toward flow orifices 44, where the fuel must make another ninety-degree turn back to an axially-directed flow in order to flow through flow orifices 44. Additional turbulence eddies are created by this second ninety-degree turn, thereby further increasing the degree of atomization of fuel and the efficiency with which fuel atomizer 30 atomizes fuel. The sharp corners and internal surfaces of each of flow orifices 44 and turbulent chamber 42 aid in efficiently atomizing the fuel by converting a greater percentage of the pressure under which the fuel is flowing into atomization.

The depth D of turbulent chamber 42 determines the degree or intensity of turbulence for atomization of the fuel and creates swirling of the fuel flowing through pressure atomizer 30. For example, depth D is from approximately 75 $\mu$m to approximately 150 $\mu$m. With the depth D chosen to be within the above-stated range, and under the above-stated range of fuel pressure, fuel will flow as a sheet substantially along the walls of flow orifices 44 and exit at an angle substantially equal to flow orifice angle 46. Flow metering and flow control is determined by dimensions S1 and S2, which are selected and etched accordingly. The spray front velocity of fuel exiting flow orifices 44 on the bottom side 30*b* is approximately 30 meters/second or less under the maximum pressures given above. Thus, a substantially lower spray front velocity is achieved relative to the typical spray front velocities of approximately forty meters/second and higher of conventional pressure atomizers. Therefore, penetration of fuel into the combustion chamber is reduced and fuel spray is substantially less likely to undesirably impinge on the combustion chamber wall. The lower spray front velocity, in part, enables substantially full-time controlled stratification of the combustion charge.

Sac volume in pressure atomizer 30 is substantially reduced relative to compound nozzles. The sac volume of a conventional compound nozzle will include at a minimum the volume of the inlet orifices and any other flow chambers up to, but not including, the outlet orifice. In contrast, the sac volume of pressure atomizer 30 comprises only the volume of turbulent chamber 42. The volume of flow orifices 44 does not comprise sac volume. Thus, sac volume is substantially reduced and a substantially smaller volume of non-atomized fuel remains within pressure atomizer 30 relative to a conventional compound nozzle. Therefore, a substantially smaller volume of non-atomized fuel is injected into the combustion chamber at the next injection invent thereby resulting in a more complete combustion process and a reduction in undesirable emissions.

Figure 7:
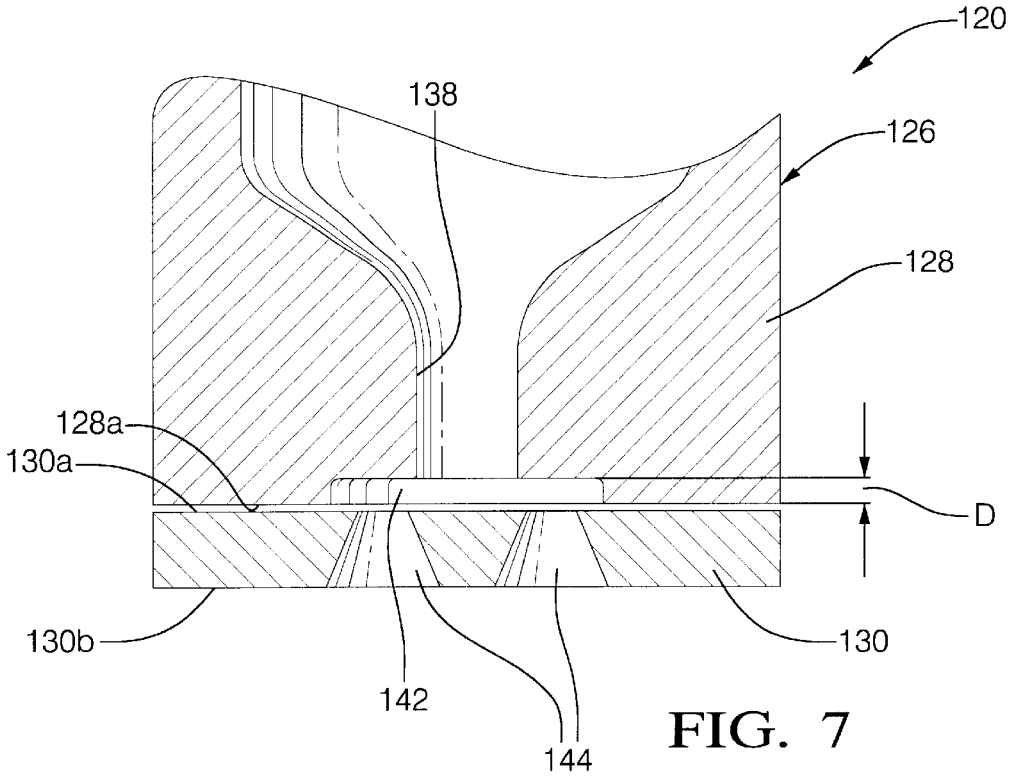
FIG. 7 is a fragmented, sectional view of a fuel injector having a second embodiment of a pressure atomizer of the present invention.

In the embodiment shown, fuel injector 20 is configured as having turbulent chamber 42 formed in a top surface of pressure atomizer 30. However, it is to be understood that fuel injector 20 may be alternately configured, such as, for example and as shown in FIG. 7, as having a turbulent chamber formed on the seat bottom. Fuel injector 120 includes lower housing and tip assembly 126. Lower housing and tip assembly 126 includes injector seat 128 which defines injector seat exit orifice 138. However, in this embodiment, turbulent chamber 142 is defined by seat bottom 128*a*. The depth D of turbulent chamber 142 remains at approximately 75 $\mu$m to approximately 150 $\mu$m. Pressure atomizer 130 is, accordingly, alternately configured as having four flow orifices 144 (only two of which are shown) which extend from bottom surface 130*b* to intersect with and open onto top surface 130*a* of pressure atomizer 130. Pressure atomizer 130 is retained against seat bottom 128*a* in a substantially similar manner as described herein in regard to pressure atomizer 30, and thus flow orifices 144 are placed into fluid communication with turbulent chamber 142 and injector seat exit orifice 138.

In the embodiment shown, pressure atomizer include four flow orifices 44 which are disposed within turbulent chamber 42 and are equidistantly spaced about central axis A. However, it is to be understood that the pressure atomizer of the present invention may be alternately configured, such as, for example, with a greater or fewer number of flow orifices which are variously configured and spaced within the turbulent chamber.

In the embodiment shown, each of flow orifices 44 are configured as square orifices. However, it is to be understood that the flow orifices may be alternately configured, such as, for example, as round or rectangular flow orifices or orifices of virtually any desirable geometry.

In the embodiment shown, the depth D of turbulent chamber 42 is configured as between approximately 75 micrometers and 150 micrometers. However, it is to be understood that the depth of the turbulent chamber may be alternately configured, such as, for example, as 175 micrometers or 50 micrometers as dictated by the particular end use and operating parameters of the pressure atomizer.

In the embodiment shown, top surface 30*a* of pressure atomizer 30 is disposed in abutting engagement with seat bottom 28*a* of injector seat 28. However, it is to be understood that fuel injector 20 may be alternately configured, such as, for example, having the top surface of the pressure atomizer disposed a predetermined distance from the injector seat bottom.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. An internal combustion engine, comprising:

a fuel injector having an injector seat having a seat bottom, said seat bottom defining an injector seat exit orifice; and a pressure atomizer, including:

a silicon plate having a top plate surface and a bottom plate surface, said top plate surface disposed proximate said seat bottom, a portion of said top plate surface defining a turbulent chamber, said turbulent chamber being peripherally bounded by said top plate surface, said turbulent chamber being recessed a predetermined depth relative to said top plate surface, at least a portion of said turbulent chamber disposed in axial alignment with said injector seat exit orifice, said silicon plate further defining at least one flow orifice extending from said bottom plate surface to intersect with and open into said turbulent chamber, said at least one flow orifice being in fluid communication with said turbulent chamber.

2. A fuel injector for use in direct injection systems, said fuel injector having a central axis, said fuel injector comprising:

an injector seat having a seat bottom, said seat bottom defining an injector seat exit orifice; and a pressure atomizer, including:

a silicon plate having a top plate surface and a bottom plate surface, said top plate surface disposed proximate said seat bottom, a portion of said top plate surface defining a turbulent chamber, said turbulent chamber being peripherally bounded by said top plate surface, said turbulent chamber being recessed a predetermined depth relative to said top plate surface, at least a portion of said turbulent chamber disposed in axial alignment with said injector seat exit orifice, said silicon plate further defining at least one flow orifice extending from said bottom plate surface to intersect with and open into said turbulent chamber, said at least one flow orifice being in fluid communication with said turbulent chamber.

3. The fuel injector of claim 2, wherein said top plate surface of said silicon plate is disposed in abutting engagement with said seat bottom.

4. The fuel injector of claim 2, wherein said at least one flow orifice comprises a plurality of flow orifices.

5. The fuel injector of claim 2, wherein said at least one flow orifice comprises at least four flow orifices.

6. The fuel injector of claim 5, wherein each of said at least four flow orifices are spaced equidistantly relative to a central axis of said fuel injector.

7. The fuel injector of claim 2, wherein each of said at least one flow orifice is substantially square.

8. The fuel injector of claim 2, wherein each of said at least one flow orifice is tapered from a first cross-sectional area proximate said turbulent chamber to a second cross-sectional area proximate said bottom surface of said silicon plate.

9. The fuel injector of claim 8, wherein said first cross-sectional area is less than said second cross-sectional area.

10. The fuel injector of claim 2, wherein said predetermined depth which said turbulent chamber is recessed from said top plate surface is from approximately 75 micrometers to approximately 150 micrometers.

11. The fuel injector of claim 2, wherein said predetermined depth which said turbulent chamber is recessed from said top surface of said silicon plate is from approximately 100 micrometers to approximately 125 micrometers.

12. The fuel injector of claim 2, further comprising a retainer cap, said retainer cap in abutting engagement with said bottom plate surface of said pressure atomizer, said retainer cap being one of attached to and interconnected with said injector seat to thereby retain said top plate surface of said silicon plate in abutting engagement with said seat bottom.

13. The fuel injector of claim 12, further comprising a washer, said washer defining an aperture therein, said pressure atomizer being received within said aperture of said washer such that said pressure atomizer is radially surrounded by said washer, an outside surface of said washer abuttingly engaging an inside surface of said retainer cap to thereby establish and maintain a position of said pressure atomizer relative to said injector seat exit orifice.

14. An internal combustion engine, comprising:

a fuel injector having an injector seat having a seat bottom, said seat bottom defining an injector seat exit orifice and a recessed turbulent chamber, said injector seat orifice being in fluid communication with said recessed turbulent chamber; and a pressure atomizer, including:

a silicon plate having a top plate surface and a bottom plate surface, said top plate surface in abutting engagement with said seat bottom, said silicon plate defining at least one flow orifice extending from said bottom plate surface to intersect with and open onto said top plate surface, said at least one flow orifice being in fluid communication with said turbulent chamber.

15. A fuel injector for use in direct injection systems, said fuel injector having a central axis, said fuel injector comprising:

an injector seat having a seat bottom, said seat bottom defining an injector seat exit orifice and a recessed turbulent chamber, said injector seat orifice being in fluid communication with said recessed turbulent chamber; and a pressure atomizer, including:

a silicon plate having a top plate surface and a bottom plate surface, said top plate surface in abutting engagement with said seat bottom, said silicon plate defining at least one flow orifice extending from said bottom plate surface to intersect with and open onto said top plate surface, said at least one flow orifice being in fluid communication with said turbulent chamber.

16. The fuel injector of claim 15, wherein said recessed turbulent chamber has a depth, said depth being from approximately 75 micrometers to approximately 150 micrometers.

17. The fuel injector of claim 15, wherein said recessed turbulent chamber has a depth, said depth being from approximately 100 micrometers to approximately 125 micrometers.

18. The fuel injector of claim 15, wherein said at least one flow orifice comprises at least four flow orifices.

19. The fuel injector of claim 18, wherein each of said at least four flow orifices are substantially square.

20. The fuel injector of claim 18, wherein each of said at least one flow orifice is tapered from a first cross-sectional area proximate said top plate surface to a second cross-sectional area proximate said bottom plate surface.

21. The fuel injector of claim 20, wherein said first cross-sectional area is less than said second cross-sectional area.

22. A pressure atomizer, comprising:

a silicon plate having a top surface and a bottom surface, a portion of said top surface defining a turbulent chamber, said turbulent chamber being peripherally bounded by said top surface, said turbulent chamber being recessed a predetermined depth relative to said top surface, said silicon plate further defining at least one flow orifice extending from said bottom surface to intersect with and open into said turbulent chamber, said at least one flow orifice being in fluid communication with said turbulent chamber.

23. The pressure atomizer of claim 22, wherein said at least one flow orifice comprises a plurality of flow orifices.

24. The pressure atomizer of claim 22, wherein said at least one flow orifice comprises at least four flow orifices.

25. The pressure atomizer of claim 24, wherein each of said at least four flow orifices are spaced equidistantly relative to a central axis of said pressure atomizer.

26. The pressure atomizer of claim 22, wherein each of said at least one flow orifice is substantially square.

27. The pressure atomizer of claim 22, wherein each of said at least one flow orifice is tapered from a first cross-sectional area proximate said turbulent chamber to a second cross-sectional area proximate said bottom surface of said silicon plate.

28. The pressure atomizer of claim 27, wherein said first cross-sectional area is less than said second cross-sectional area.

29. The pressure atomizer of claim 22, wherein said predetermined depth which said turbulent chamber is recessed from said top surface of said silicon plate is from approximately 75 micrometers to approximately 150 micrometers.

30. The pressure atomizer of claim 22, wherein said predetermined depth which said turbulent chamber is recessed from said top surface of said silicon plate is from approximately 100 micrometers to approximately 125 micrometers.

31. A method of atomizing fuel, comprising:

flowing fuel through an exit orifice of a fuel injector in a controlled manner; and associating a pressure atomizer with said exit orifice, said pressure atomizer defining a turbulent chamber and at least one flow orifice, each of said at least one flow orifice being in fluid communication with said turbulent chamber.

32. The method of atomizing fuel of claim 31, wherein said flowing step occurs at a pressure of from approximately 1.5 MPa to less than approximately 5 MPa.

* * * * *